US006000303A

United States Patent [19]

Chang

[11] Patent Number: 6,000,303

[45] Date of Patent: Dec. 14, 1999

[54] PLIERS

[76] Inventor: Jong-Shing Chang, No. 5, Chang Ma Street, Ma Hsing Village, Shiow Shoei Shi, Chang Huah, Taiwan

[21] Appl. No.: 09/035,086

[22] Filed: Mar. 5, 1998

[51] Int. Cl.[6] ..... B25B 7/04

[52] U.S. Cl. ..... 81/341; 81/407; 81/413

[58] Field of Search ..... 81/341, 342, 355, 81/357, 358, 367, 373, 405–414

[56] References Cited

U.S. PATENT DOCUMENTS 4,651,598 3/1987 Warheit .
4,662,252 5/1987 Warheit .
5,660,089 8/1997 Chow ..... 81/407 X

*Primary Examiner*—James G. Smith
*Attorney, Agent, or Firm*—Browdy and Neimark

[57] ABSTRACT

A pliers is composed of a first long member and a second long member having a middle neck portion which is provided with a long slot. Pivoted to the first long member is a stopping member, which is located in the long slot and provided with a serrated portion engageable with teeth of the long slot. A first spring is fitted over a second support arm which forms an angle with a first support arm. A second spring is fastened at one end thereof with a grip end of the first long member, and at another end thereof with a grip end of the second long member. The first and the second long members are forced by the springs to open up completely in the absence of an external force exerting on the pliers.

5 Claims, 4 Drawing Sheets

PLIERS

FIELD OF THE INVENTION

The present invention relates generally to a pliers, and more particularly to a pliers having a curved toggle for assisting the holding of a work piece.

BACKGROUND OF THE INVENTION

The conventional pliers is generally composed of two jaws which are pivotally coupled such that the two jaws can hold securely a work piece. Such a conventional pliers is defective in design in that the distance between the two jaws can not be adjusted to hold the work pieces of various sizes. Another conventional pliers is composed of two jaws which can be adjusted in distance separating the two jaws for holding the work pieces of various sizes. However, the pivot of the pliers is vulnerable to sliding to result in the poor clamping of the work piece. The pliers disclosed in the U.S. Pat. Nos. 4,651,598 and 4,662,252 are intended to overcome the drawbacks of the conventional pliers described above; nevertheless they can not be easily assembled in view of the embedded biasing spring of the pliers.

SUMMARY OF THE INVENTION

It is therefore the primary objective of the present invention to provide a pliers capable of holding workpieces of various sizes.

It is another objective of the present invention to provide a pliers capable of holding securely a workpiece.

It is still another objective of the present invention to provide a pliers simple in construction for easy assembly.

In keeping with the principle of the present invention, the foregoing objectives of the present invention are attained by an improved pliers consisting of a first long member and a second long member having a middle neck provided with a long slot. Pivoted to the first long member is a pawl, which is located in the long slot and provided with a serrated portion engageable with the teeth of the long slot. A first spring is fitted over a second support arm, which form an angle with a first support arm. A second spring is fastened at one end thereof with a grip end of the first long member, and at another end thereof with a grip end of the second long member. The first and the second long members are forced by the springs to open up completely in the absence of an external force exerting on the pliers.

DETAILED DESCRIPTION OF THE INVENTION

Figure 1:
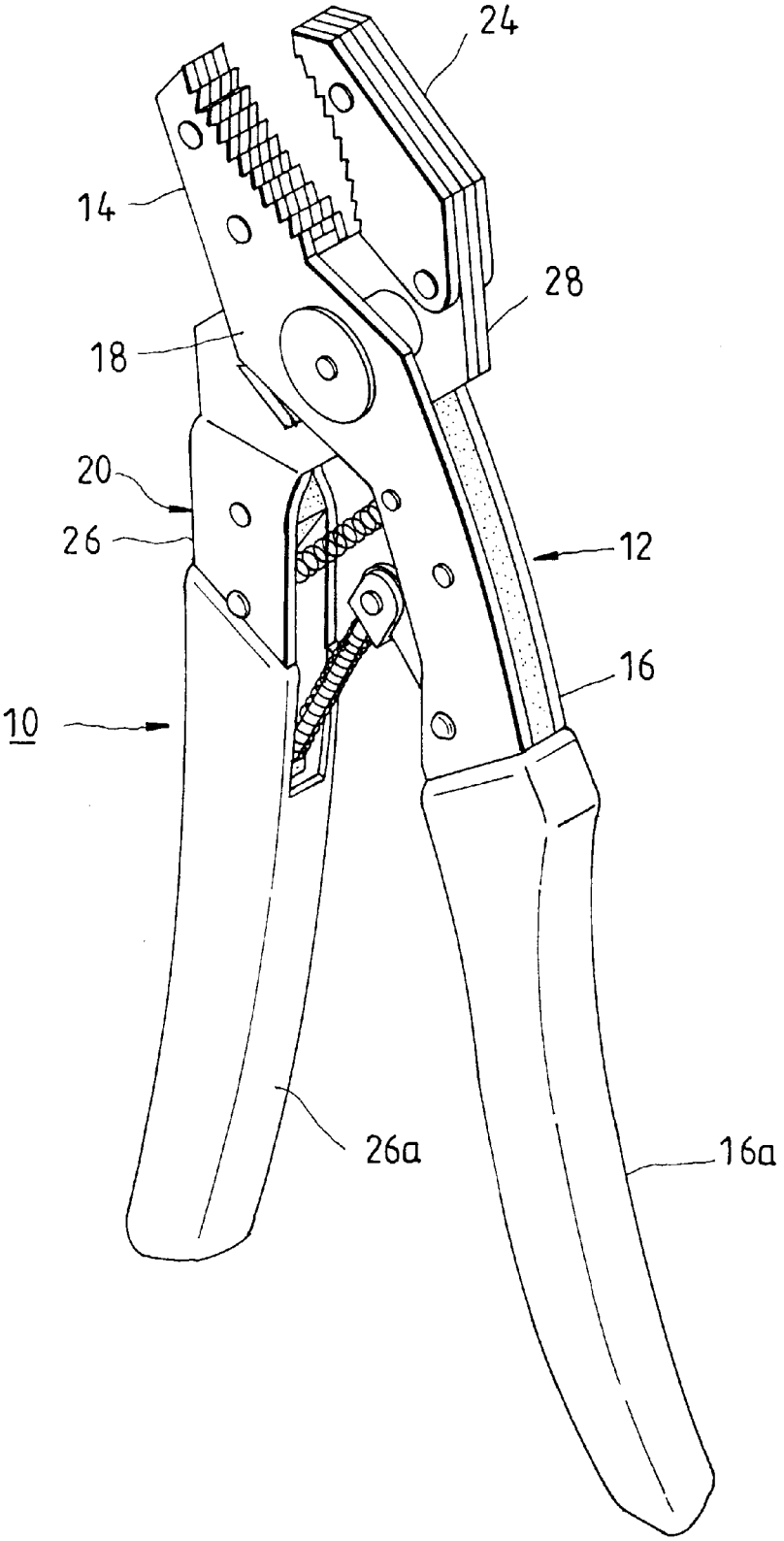
FIG. 1 shows a perspective view of the present invention.
Figure 2:
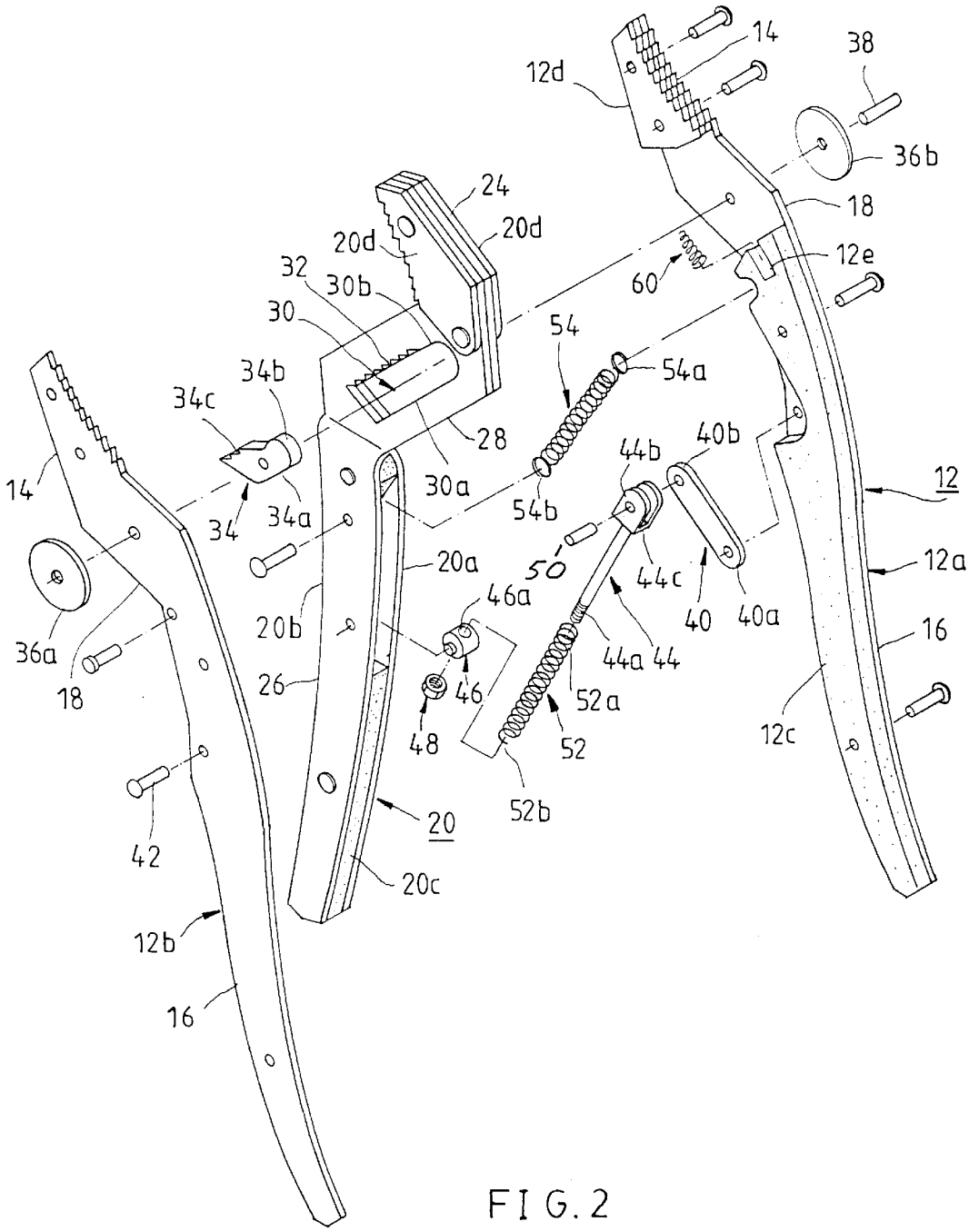
FIG. 2 shows an exploded view of the present invention.

As shown in FIGS. 1 and 2, a pliers 10 of the present invention is composed of a first long member 12 and a second long member 20.

The first long member 12 is composed of two identical long pieces 12*a* and 12*b*, two middle partitions 12*c* and 12*d*, which are superimposed. The first long member 12 has a jaw end 14, a grip end 16, and a middle neck portion 18.

The second long member 20 is composed of two identical long pieces 20*a* and 20*b*, a middle partition 20*c*, and two outer laminated pieces 20*d*, which are superimposed. The second long member 20 has a jaw end 24, a grip end 26, and a middle neck portion 28. The grip ends 16 and 26 are provided respectively with a soft plastic jacket 16*a*, 26*a*.

The middle neck portion 28 is put through the middle neck portion 18 and is provided with a long slot 30 having two parallel long sides 30*a* and 30*b*. The long side 30*b* is provided with a series of teeth 32. A pawl 34 is located in the long slot 30 such that the pawl 34 is fastened pivotally with the middle neck portion 18 by a pin 38 and two cushions 36*a* and 36*b*. The stopping member 34 has a straight surface 34*a*, a cam surface 34*b*, and a serrated portion 34*c*.

A first support arm 40 has a first end 40*a* which is fastened pivotally with the grip end 16 of the first long member by a first pin 42. A second support arm 44 has a first end 44*a* engaged with a through hole 46*a* of a second pin 46 fastened pivotally in the inner space of the grip end 26 of the second long member 20. A stopping member 48 is fastened with the end of the first end 44*a*. The first and the second support arms 40 and 44 are fastened pivotally by a pivot 50. The second support arm 44 is longer than the first support arm 40. The first pin 42 is located at a higher level above the ends of the handles than the second pin 46. The second end 44*b* of the second support arm is provided with a stopping portion 44*c* for enabling the two support arms to form a curved toggle of about 90 degrees. A first spring 52 is fitted over the second support arm 44 such that one end 52*a* of the first spring 52 urges the second end 44*b* of the second support arm, and that another end of the spring 52 urges the second pin 46. A second spring 54 is fastened at one end 54*a* thereof with the grip end 16 of the first long member 12, and at another end 54*b* thereof with the grip end 26 of the second long member 20.

Figure 3:
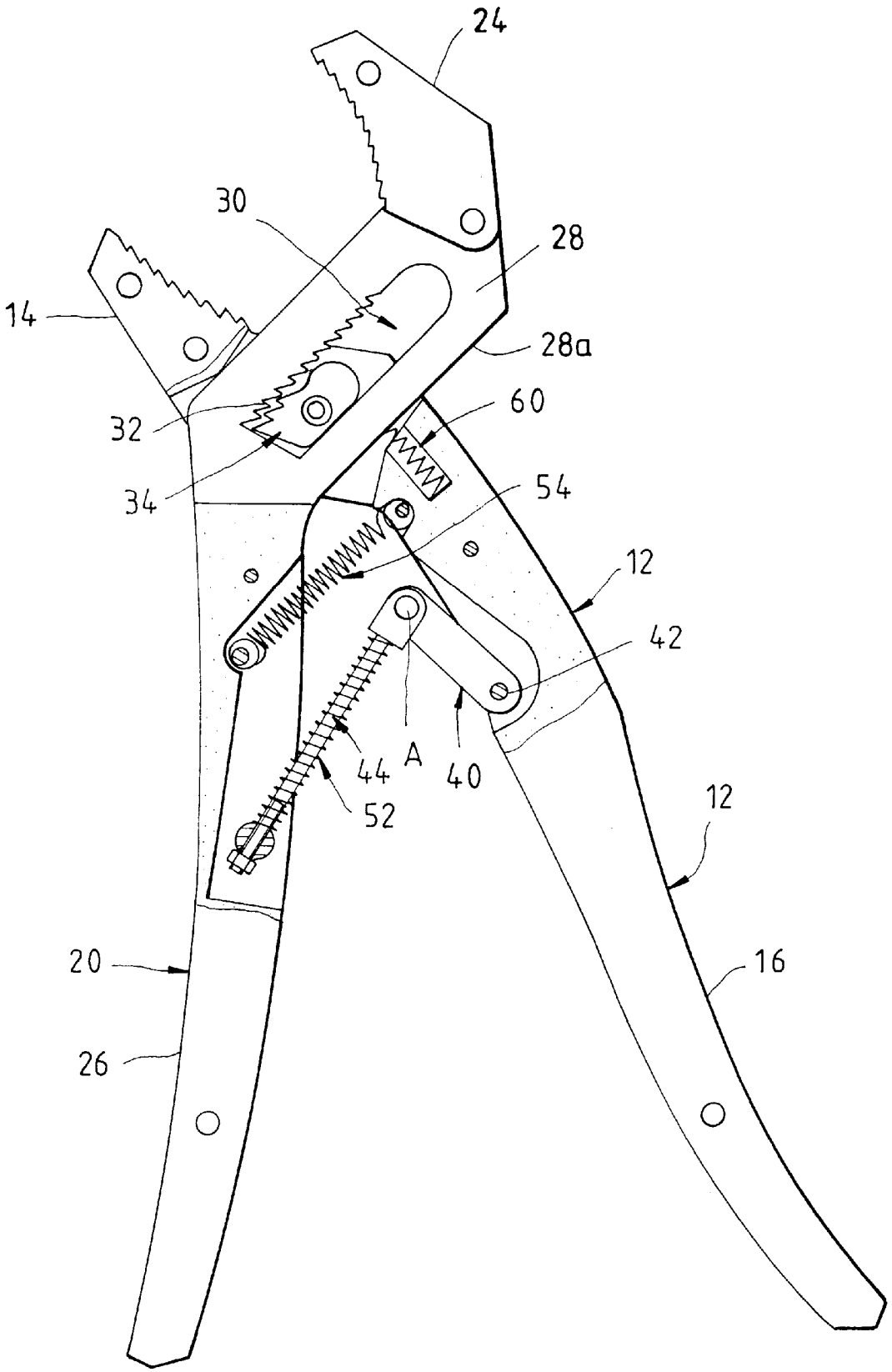
FIG. 3 shows a partial sectional view of the present invention at work.
Figure 4:
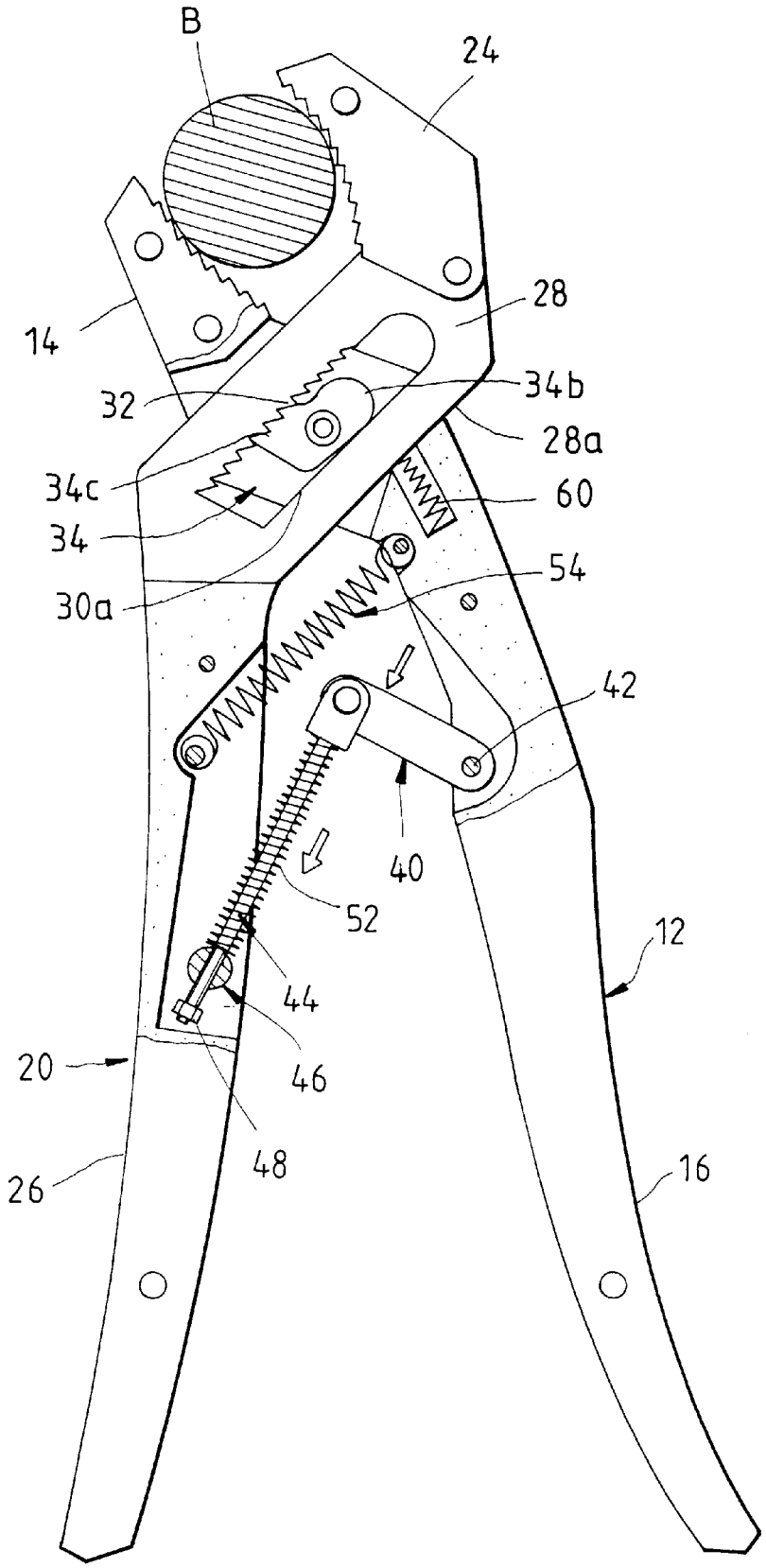
FIG. 4 shows another partial sectional view of the present invention at work.

As illustrated in FIG. 3, when the pliers 10 is not exerted on by an external force, the energy released by the sprigs 52 and 54 enables the pivoting point A of the two support arms to be close to the first long member 12. As a result, the first and the second long members 12 and 20 are completely opened. The middle partition 12*c* is provided in the top side thereof with a recess 12*e* in which a tapered third spring 60 is located such that the upper end of the third spring 60 urges a side 28*a* of the second long member so as to keep the teeth 32 of the long slot 30 apart from the pawl 34.

When the pliers 10 is not at work, the jaw ends 14 and 24, and the grip ends 16 and 26 are completely opened as shown in FIG. 3. When the grip ends 16 and 26 are exerted on by the pressure of the palm, the two jaw ends 14 and 24 are moved toward each other to hold a workpiece B. Furthermore, when the grip ends 16 and 26 are forced toward each other, the jaw ends 14 and 24 turn on the first pin 42 acting as a pivot, so as to pull the second spring 54. In the meantime, the first support arm 40 turns away from the first long member 12 to push the second support arm 44 to move toward the second long member 20, as in the direction indicated by the arrow.

When the jaw ends 14 and 24 are in contact with the workpiece B, the second support arm 44 can be forced by an added external force to compress the second spring 52. In the meantime, the two jaw ends 14 and 24 are driven to turn. The motion is then imparted to the pawl 34, which is thus caused to turn such that the cam surface 34*b* is pressed against the straight side 30*a* of the long slot 30, and that the serrated portion 34*c* is engaged with the teeth 32 of the long slot. As a result, the two jaw ends bring about a fastening motion capable of holding the workpiece B securely.

When the pliers 10 is relieved of the external force exerting thereon, the first spring 52 is in the released state such that the second support arm 44 is returned to its original position. In the meantime, the second spring 54 is returned to its original shape, whereas the third spring 60 is in the released state. As a result, the middle neck portion 28 of the second long member is pushed away from the pawl 34. The jaw ends and the grip ends of the two long members are returned to remain in the open state.

What is claimed is:

1. A pliers comprising:

a first long member having a jaw end, a grip end, and a middle neck portion;

a second long member having a jaw end, a grip end, and a middle neck portion provided with a long slot having two long sides parallel to each other, one of said two long sides provided with a series of teeth;

a pawl pivoted to said middle neck portion of said first long member and located in said long slot;

a first support arm having a first end which is pivoted to said grip end of said first long member by a first pin acting as a pivot, said first support arm further having a second end;

a second support arm longer than said first support arm and having a first end pivoted to said grip end of said second long member by a second pin acting as a pivot, said first end of said second support arm being fastened with a stopping member, said second support arm further having a second end which is pivoted to said second end of said first support arm;

a first spring fitted over said second support arm such that one end of said first spring urges said second end of said second support arm, and that another end of said first spring urges said second pin; and a second spring fastened at one end thereof with said grip end of said first long member, and at another end thereof with said grip end of said second long member.

2. The pliers as defined in claim 1, wherein the stopping portion of said second end of said second support arm is capable of keeping said first support arm and said second support arm at an angle of 90 degrees.

3. The pliers as defined in claim 1, wherein said first long member has a partition member which is provided in a top side thereof with a recess; and wherein said first long member is provided with a third spring which is located in said recess such that one end of said third spring urges one side of said middle neck portion of said second long member so as to keep said teeth of said long slot apart from said pawl at such time when said teeth of said long slot are not exerted on by a force.

4. The pliers as defined in claim 1, wherein said pawl has a cam surface.

5. The pliers as defined in claim 1, wherein said second spring is fastened at one end thereof with a portion of said grip end of said first long member, with said portion of said grip end being contiguous to said middle neck portion of said first long member.

* * * * *